US006561892B2

(12) United States Patent
Kolkebeck

(10) Patent No.: US 6,561,892 B2
(45) Date of Patent: May 13, 2003

(54) SASH SENSING SYSTEM AND METHOD

(75) Inventor: Kenneth W. Kolkebeck, Harrington Park, NJ (US)

(73) Assignee: Tek-Air Systems, Inc., Danbury, CT (US)

( * ) Notice: Subject to any disclaimer, the term of this patent is extended or adjusted under 35 U.S.C. 154(b) by 0 days.

(21) Appl. No.: 09/878,890

(22) Filed: Jun. 11, 2001

(65) Prior Publication Data

US 2002/0187743 A1 Dec. 12, 2002

(51) Int. Cl.[7] ..... B08B 15/02
(52) U.S. Cl. ..... 454/61; 454/56
(58) Field of Search ..... 454/56, 59, 61; 49/13; 361/139, 142

(56) References Cited

U.S. PATENT DOCUMENTS

| | | | | |
|---|---|---|---|---|
| 3,440,022 A | | 4/1969 | Elmore | 23/292 |
| 4,067,691 A | | 1/1978 | McGady et al. | 21/56 |
| 4,466,341 A | | 8/1984 | Grogan | 98/115 LH |
| 4,652,821 A | | 3/1987 | Kreft | 324/208 |
| 4,698,996 A | | 10/1987 | Kreft et al. | 73/1 J |
| 4,741,257 A | | 5/1988 | Wiggin et al. | 98/115.3 |
| 4,893,551 A | | 1/1990 | Sharp et al. | 98/115.3 |
| 4,948,566 A | | 8/1990 | Gabele et al. | 422/107 |
| 5,056,049 A | | 10/1991 | O'Neill | 364/562 |
| 5,117,746 A | | 6/1992 | Sharp | 454/61 |
| 5,226,256 A | | 7/1993 | Fries et al. | 49/13 |
| 5,305,390 A | | 4/1994 | Frey et al. | 382/2 |
| 5,347,754 A | | 9/1994 | Jacob | 49/13 |
| 5,406,073 A | | 4/1995 | Sharp et al. | 250/221 |
| 5,470,275 A | * | 11/1995 | Jacob et al. | 454/59 |
| 5,534,849 A | | 7/1996 | McDonald et al. | 340/517 |
| 5,545,086 A | * | 8/1996 | Sharp et al. | 454/238 |
| 5,562,537 A | | 10/1996 | Zver et al. | 454/61 |
| 5,589,769 A | | 12/1996 | Krahn | 324/207.26 |
| 5,733,188 A | | 3/1998 | Jacob | 454/56 |
| 5,736,793 A | | 4/1998 | Jahrsetz et al. | 307/10.1 |
| 5,832,842 A | | 11/1998 | Frontini et al. | 110/190 |
| 5,898,557 A | | 4/1999 | Baba et al. | 361/103 |
| 6,137,403 A | | 10/2000 | Desrochers et al. | 340/540 |

FOREIGN PATENT DOCUMENTS

| | | | |
|---|---|---|---|
| EP | 0 541 864 A1 | 5/1993 | B08B/15/02 |
| GB | 2 076 145 A | 11/1981 | B08B/15/02 |

* cited by examiner

*Primary Examiner*—Derek Boles
(74) *Attorney, Agent, or Firm*—Fay, Sharpe, Fagan, Minnich & McKee, LLP

(57) ABSTRACT

A sash position sensing system for a fume hood (10) and the like having a plurality of movable sashes (12*a*, 12*b*, 12*c*, 12*d*) in a frame includes an indicator element (24) affixed to each sash and an array (20) of sensor elements (22) extending along the frame. The sensor elements interact with the indicator elements when generally aligned therewith. The status of the sensor elements is captured in parallel without the need for multiplexing the sensor array, and a processor (52) reads the captured state information and calculates the open area of the frame. In further aspects, a method for determining the position of one or movable sashes in a frame and a fume hood employing the sash position sensing system of the present invention are also provided.

20 Claims, 8 Drawing Sheets

| Bit | Status | Counter | TLC |
|---|---|---|---|
| 60 | A | 1 | 0 |
| 59 | | 2 | 0 |
| 58 | | 3 | 0 |
| 57 | | 4 | 0 |
| 56 | | 5 | 0 |
| 55 | | 6 | 0 |
| 54 | | 7 | 0 |
| 53 | A | 1 | 7 |
| 52 | | 2 | 7 |
| 51 | | 3 | 7 |
| 50 | | 4 | 7 |
| 49 | | 5 | 7 |
| 48 | | 6 | 7 |
| 47 | | 7 | 7 |
| 46 | | 8 | 7 |
| 45 | | 9 | 7 |
| 44 | | 10 | 7 |
| 43 | | 11 | 7 |
| 42 | | 12 | 7 |
| 41 | | 13 | 7 |
| 40 | | 14 | 7 |
| 39 | | 15 | 7 |
| 38 | | 16 | 7 |
| 37 | | 17 | 7 |
| 36 | | 18 | 7 |
| 35 | | 19 | 7 |
| 34 | | 20 | 7 |
| 33 | | 0 | 27 |
| 32 | | 0 | 27 |
| 31 | | 0 | 27 |

| Bit | Status | Counter | TLC |
|---|---|---|---|
| 30 | | 0 | 27 |
| 29 | | 0 | 27 |
| 28 | | 0 | 27 |
| 27 | | 0 | 27 |
| 26 | | 0 | 27 |
| 25 | | 0 | 27 |
| 24 | | 0 | 27 |
| 23 | | 0 | 27 |
| 22 | A | 1 | 27 |
| 21 | | 2 | 27 |
| 20 | | 1 | 27 |
| 19 | | 2 | 27 |
| 18 | | 3 | 27 |
| 17 | | 4 | 27 |
| 16 | | 5 | 27 |
| 15 | | 6 | 27 |
| 14 | | 7 | 27 |
| 13 | | 8 | 27 |
| 12 | | 9 | 27 |
| 11 | | 10 | 27 |
| 10 | | 11 | 27 |
| 9 | | 12 | 27 |
| 8 | | 13 | 27 |
| 7 | | 14 | 27 |
| 6 | | 15 | 27 |
| 5 | | 16 | 27 |
| 4 | | 17 | 27 |
| 3 | | 18 | 27 |
| 2 | | 19 | 27 |
| 1 | | 20 | 47 |

FIG. 9

SASH SENSING SYSTEM AND METHOD

BACKGROUND OF THE INVENTION

The present invention relates generally to a position sensing apparatus. It finds particular application to laboratory fume hoods having one or more moveable doors in which the rate of exhaust is varied in accordance with the extent to which the doors are open. Although the present invention is described herein primarily in reference to laboratory fume hood doors, it will be appreciated that the present invention is also amenable to other structures which are generally moveable along a predetermined path.

Fume hoods are used in laboratories and other like environments to provide a work place where potentially dangerous chemicals are used. Such fume hoods generally comprise an enclosure having moveable doors at the front portion thereof which can be opened in various amounts to permit access to the interior of the enclosure. The enclosure is typically connected to an exhaust system for removing any noxious fumes so as to avoid exposure to persons working in or near the hood.

Conventionally, fume hood controllers control the flow of air through the fume hood to maintain desired flow characteristics to efficiently exhaust the fumes from the enclosure. Typically, the air flow is a function of the desired average face velocity of the opening of the fume hood. The average face velocity is the flow of air into the fume hood per square foot of open face area of the fume hood.

The sash doors of some fume hoods can be opened by raising them vertically. Other hoods have a number of doors that are mounted for horizontal sliding movement, typically in two or more sets of tracks. Fume hoods in which horizontally sliding doors are mounted in a vertically movable frame for two modes of opening are also known. Prior fume hood controllers have included sensing means for measuring the absolute position of vertical doors and/or the relative positions of horizontal doors and then using a signal proportional to the sensed position to vary the speed of the blowers or to vary the position of the dampers. A drawback of sensing relative sash position is the use of very large indicators, for example, elongated magnets traversing the entire width of each sash.

Position sensors using a magnet indicator and an array of sensor elements, such as Hall effect sensors, are generally known in the art. Because Hall effect sensors have high power consumption, a multiplexing scheme is often used in which the sensors are individually enabled and their output scanned sequentially. See, for example, U.S. Pat. No. 5,589,769 to Krahn, which discloses a position sensor including an array of transducers (22) wired to a multiplexer (30). Similarly, U.S. Pat. No. 5,534,849 to McDonald et al. discloses a position sensor which uses multiple magnetic field sensors (12) mounted on a door frame and magnet actuators (15A, 15B, 15C) mounted on a movable door. The magnetic field sensors are preferably Hall effect semiconductor devices. The sensors are enabled and sampled one at a time using multiplexer (18). U.S. Pat. No. 5,733,188 to Jacob discloses a multiplexer (130) in a fume hood sash position sensing system.

Accordingly, the present invention contemplates a new and improved position sensing apparatus and fume controller which overcomes the above-referenced problems and others.

SUMMARY OF THE INVENTION

In a first aspect, a method is provided for determining the position of one or more sashes in a frame is provided, wherein the frame defines an opening and the sashes are movable to change an extent to which the sashes cover the opening. The frame is divided into a plurality of distinct regions along its length and a sensor element is associated with each region to form a sensor array. The sensor elements are responsive to indicator elements carried on each sash when aligned therewith. The position information is determined by capturing sensor state information for each sensor in the array in parallel.

In a second aspect, the present invention provides a sash position sensing system for a fume hood having a plurality of movable sashes in a frame includes an indicator element affixed to each sash and an array of sensor elements extending along the frame in the direction of sash motion. The sensor elements interact with said indicator elements when generally aligned. A computer-based information handling system is coupled to the array of sensor elements, which recording state information for each sensor element simultaneously.

In a third aspect of the subject invention, a fume hood includes a housing having an opening formed therein and a plurality of sashes movable to cover and uncover portions of the opening. An indicator element is affixed to each sash and an array of sensor elements extend along the frame. The sensor elements interact with the indicator elements when aligned. A computer-based information handling system, which is coupled to the array of sensor elements, records state information for each sensor element simultaneously.

One advantage of the present invention is that absolute sash position is calculated.

Another advantage resides in the use of low power consumptive sensors.

Another advantage of the present invention is that a multiplexed sensor array is not required, thus eliminating the need for intermittent sensor operation.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings, wherein like reference numerals are used to denote like or similar components throughout the several views, are only for purposes of illustrating preferred embodiments and are not to be construed as limiting the invention.

FIG. 9 is a table illustrating the manner of incrementing and addition when the method of FIG. 7 is employed with the sash configuration shown in FIG. 8.

DETAILED DESCRIPTION OF THE PREFERRED EMBODIMENTS

Figure 2:
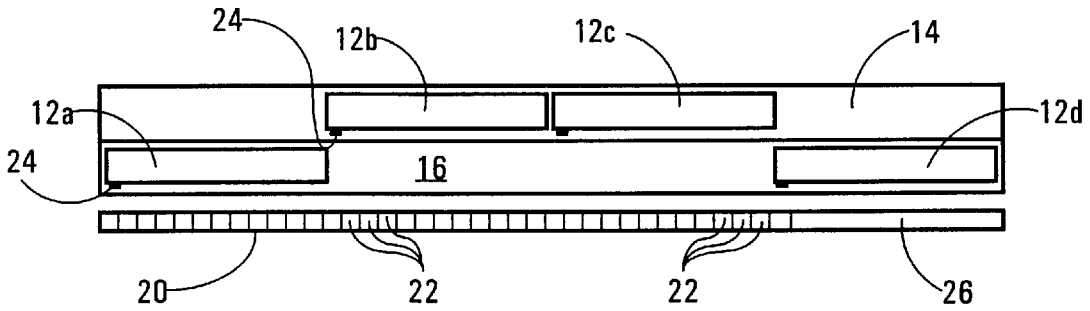
FIG. 2 is a top view of the sliding door assembly and position sensor shown in FIG. 1.
Figure 1:
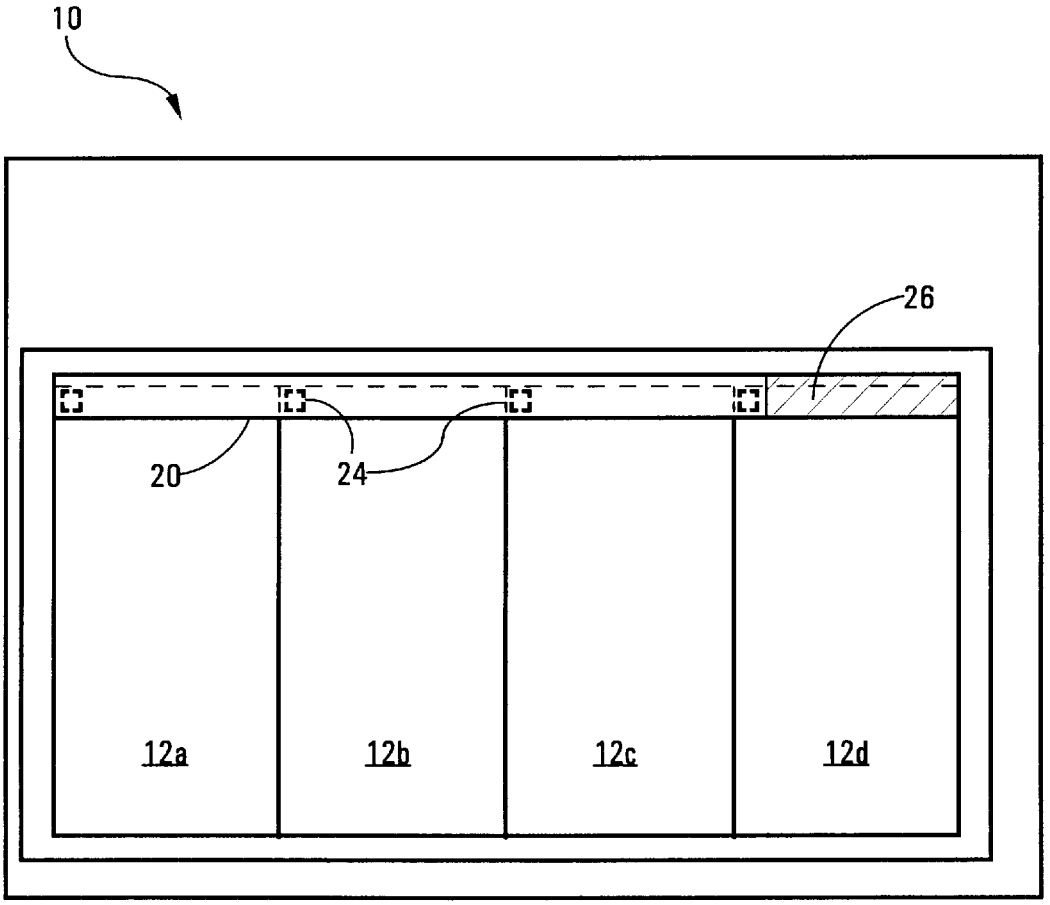
FIG. 1 is a front view of a laboratory fume hood having four horizontally movable sash doors and a position sensing apparatus in accordance with the present invention.

Referring now to FIGS. 1 and 2, a fume hood 10 includes an opening which is covered by four horizontally mounted sashes 12*a*–12*d*. In the typical arrangement shown, the sashes are carried in two parallel tracks 14 and 16 such that the sashes overlap when the sashes are open. It will be recognized that the present invention is equally applicable to fume hoods having more than four sashes or fewer than four sashes, for example, 2, 3, 6, or other numbers of sashes. Likewise, additional numbers of tracks can also be used.

An array 20 of sensor elements 22 is mounted along the length of the fume hood opening for detecting the position of each sash. The spacing between sensor elements can be varied depending on the desired resolution. The sensors are preferably spaced about every 0.5 cm to about 5 cm, most preferably about every 2.5 cm. The sensor elements 22 interact with indicator elements 24 mounted on each sash. The indicator elements are preferably point magnets and the sensor elements are magnetically actuated devices. Preferably, the sensor elements are magnetic reed switches or relays, although other devices, preferably devices with low power consumption, are also contemplated. Since each indicator element 24 is located at or near the edge of the sashes, the sensor element array extends only along a portion of the opening corresponding to the travel of the magnets. The sensor elements are omitted in a region 26, a portion of the fume hood opening along which the indicator elements do not travel. Optionally, the region 26 may advantageously be used for mounting the microprocessor and other onboard electronics, thereby avoiding the need for separately housing and mounting such components elsewhere. This allows the entire sensing unit to be housed in a single sensing strip 20.

Figure 4:
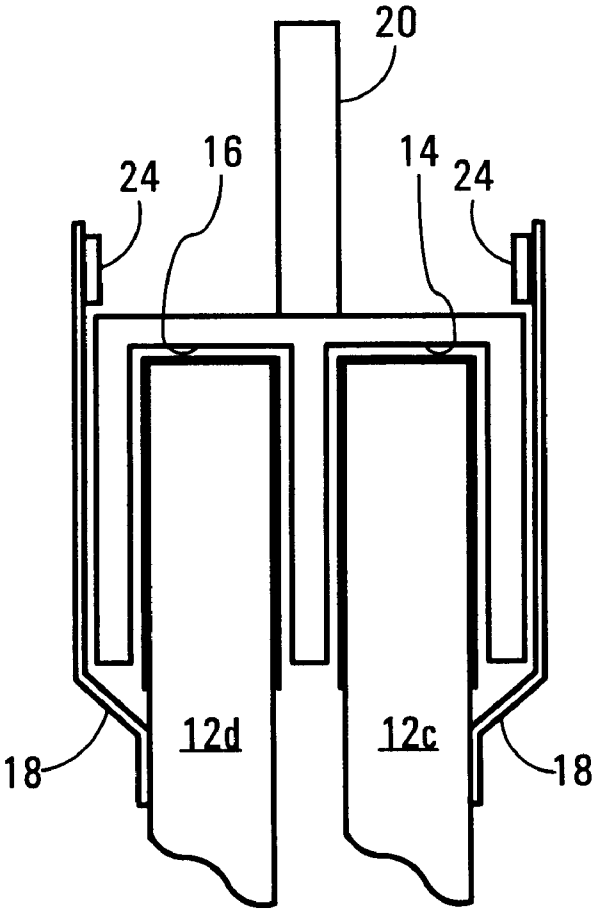
FIG. 4 is a side view of a sliding door assembly including a position sensing apparatus in accordance with the present invention showing an alternative arrangement of components.
Figure 3:
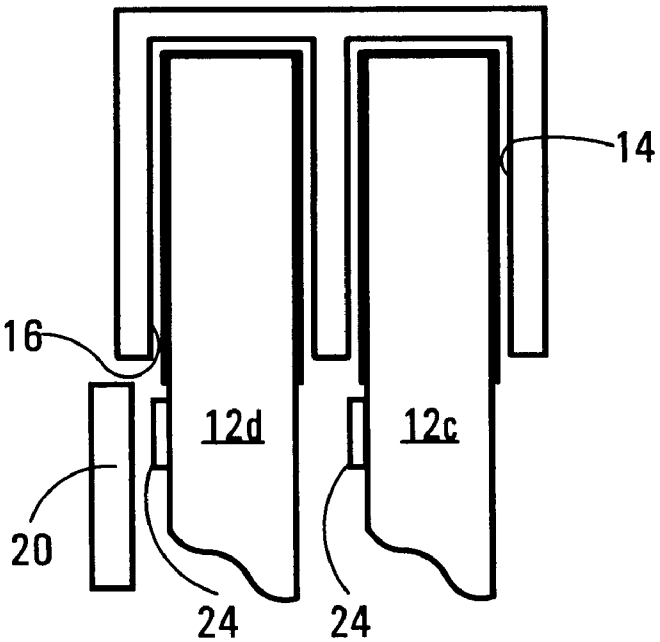
FIG. 3 is a side view of the sliding door assembly shown in FIGS. 1 and 2 illustrating a first arrangement of components.

In FIG. 3, sashes 12*c* and 12*d* travel in respective tracks 14 and 16, with the position indicators 24 in alignment with the sensing strip 20 and movable along its length. In FIG. 4, an alternative embodiment is illustrated in which the sensor strip 20 is mounted directly above the tracks 14 and 16. The indicator elements 24 are mounted on brackets or arms 18, which are attached to the sashes, and which hold the indicator elements in general alignment with the sensor array 20.

Figure 5:
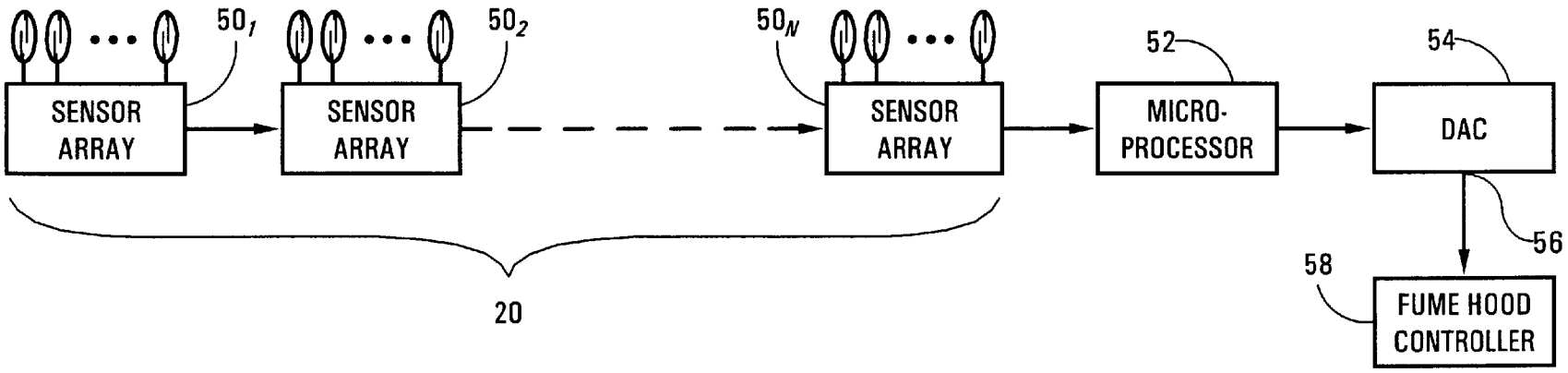
FIG. 5 is a functional block diagram of the position sensing apparatus of the present invention.

Referring now to FIG. 5, a system for maintaining a generally constant or average target face velocity in a fume hood is connected with the sensor array 20, which is optionally segmented into N smaller arrays $\mathbf{50}_1$–$\mathbf{50}_N$, where N is one or greater. The N arrays $\mathbf{50}_1$–$\mathbf{50}_N$ are connected in series to a microprocessor 52, which receives sash position information and calculates the open face area of the fume hood. In addition to sash position information collected from the sensors, the microprocessor uses input values for (1) the total width of the fume hood opening, and (2) the width of each sash, such information preferably being user selectable or programmable, to calculate the percentage of open face area. In a preferred embodiment, the system is customizable for use with a variety of fume hood size and sash width configurations by providing an operator input for entry of the opening total width and sash width, e.g., such as manually adjustable dual in-line package (DIP) switches, key pad, programmable memory, and the like.

After the percentage of open face area is calculated, the microprocessor outputs this value to a digital-to-analog converter (DAC) 54. The DAC 54 and associated signal conditioning circuitry transmits a control signal 56 to a fume hood controller 58 to achieve the target or selected face velocity, e.g., by regulating the velocity of one or more fans or blowers, adjusting air outlet damper position, and the like. Preferably, the control signal 56 is an industry standard 4–20 mA signal.

Figure 6:
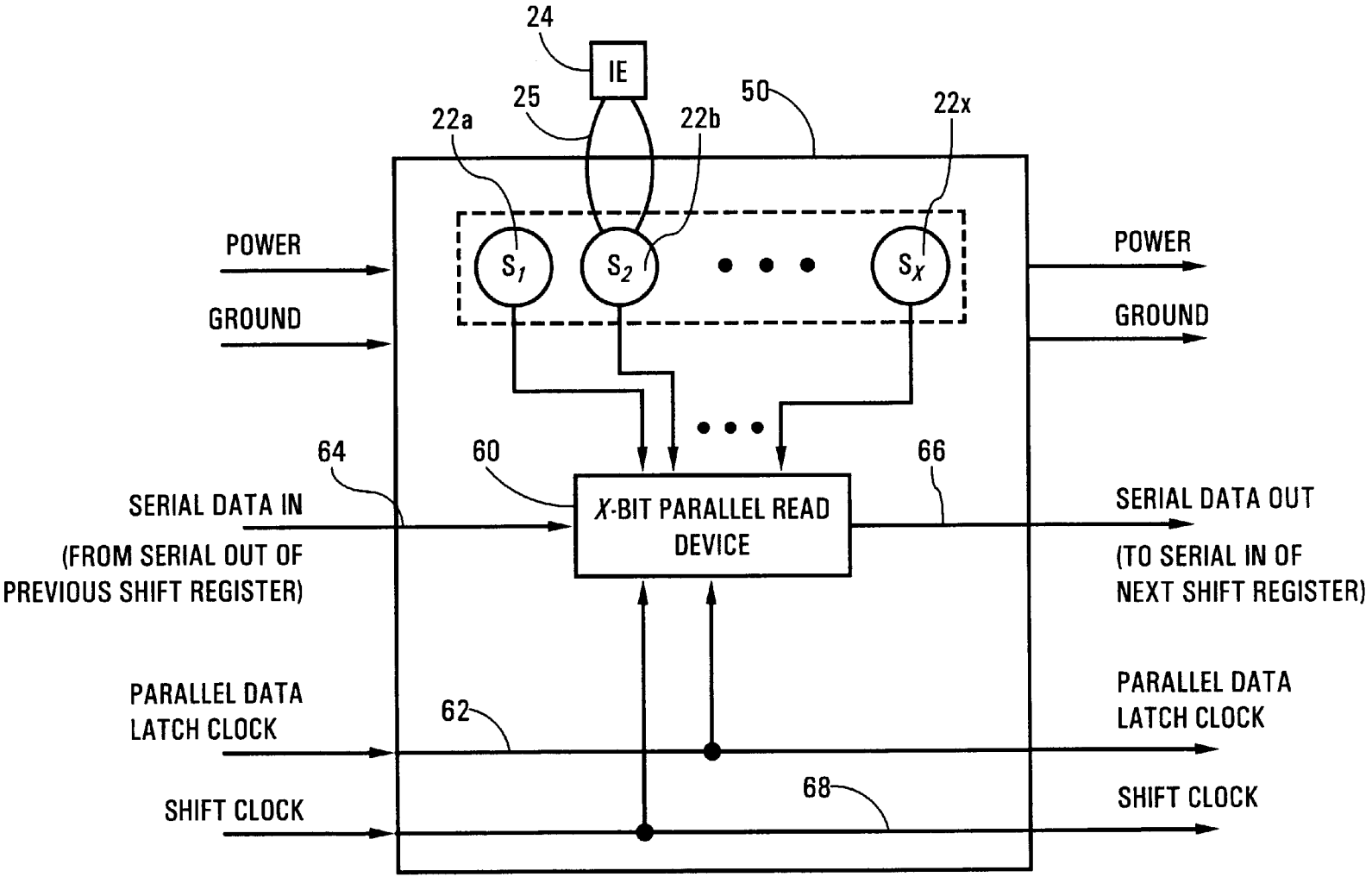
FIG. 6 is a block diagram of a preferred embodiment of the present invention.

In FIG. 6, an individual sensor array 50 is shown in greater detail. Each sensor array 50, which may be built on a conventional circuit board, includes X sensor elements 22*a*, 22*b*, up to 22*x*, which are connected in parallel to a parallel-input device 60, where X is the number of bits, or individual inputs, of the input device 60. The input device may be any volatile or nonvolatile digital storage circuit, such as a register, shift register, dedicated microprocessor, look-up table, programmable logic array (PLA), and so forth.

The sash carries an indicator element 24, e.g., a magnet having a flux field 25. As the indicator element moves along the length of the track, the adjacent sensor (e.g., sensor 22*b* in the illustrated embodiment), such as a reed switch or the like, is activated.

The switch states of the X sensor elements are latched simultaneously into the one or more shift register by a latch command signal of latch clock 62. Although FIG. 6 illustrates only a single sensor array 50, it is to be understood that an appropriate number of read devices are employed to give each sensor element a discrete input, thereby allowing the sensor status data to be collected generally at once and obviating the need for multiplexing the sensor array. The status of all other cascaded sensor arrays is also captured concurrently by the same latch command signal.

In one embodiment, multiple X-bit parallel-input shift registers are cascaded such that the serial input 64 of each shift register in the cascade is fed by a serial output line 66 from the adjacent upstream shift register. The contents of the shift registers are then shifted through the cascaded shift registers and into the microprocessor by a plurality of high frequency shift command pulses from a shift clock 68. When all bits are received by the microprocessor, the microprocessor commands the shift registers to repeat the process. This is to capture the current status of all sensor elements and then shift or march the captured states in a bucket brigade to the microprocessor. The process repeats periodically to monitor for changes in sash position.

Figure 7:
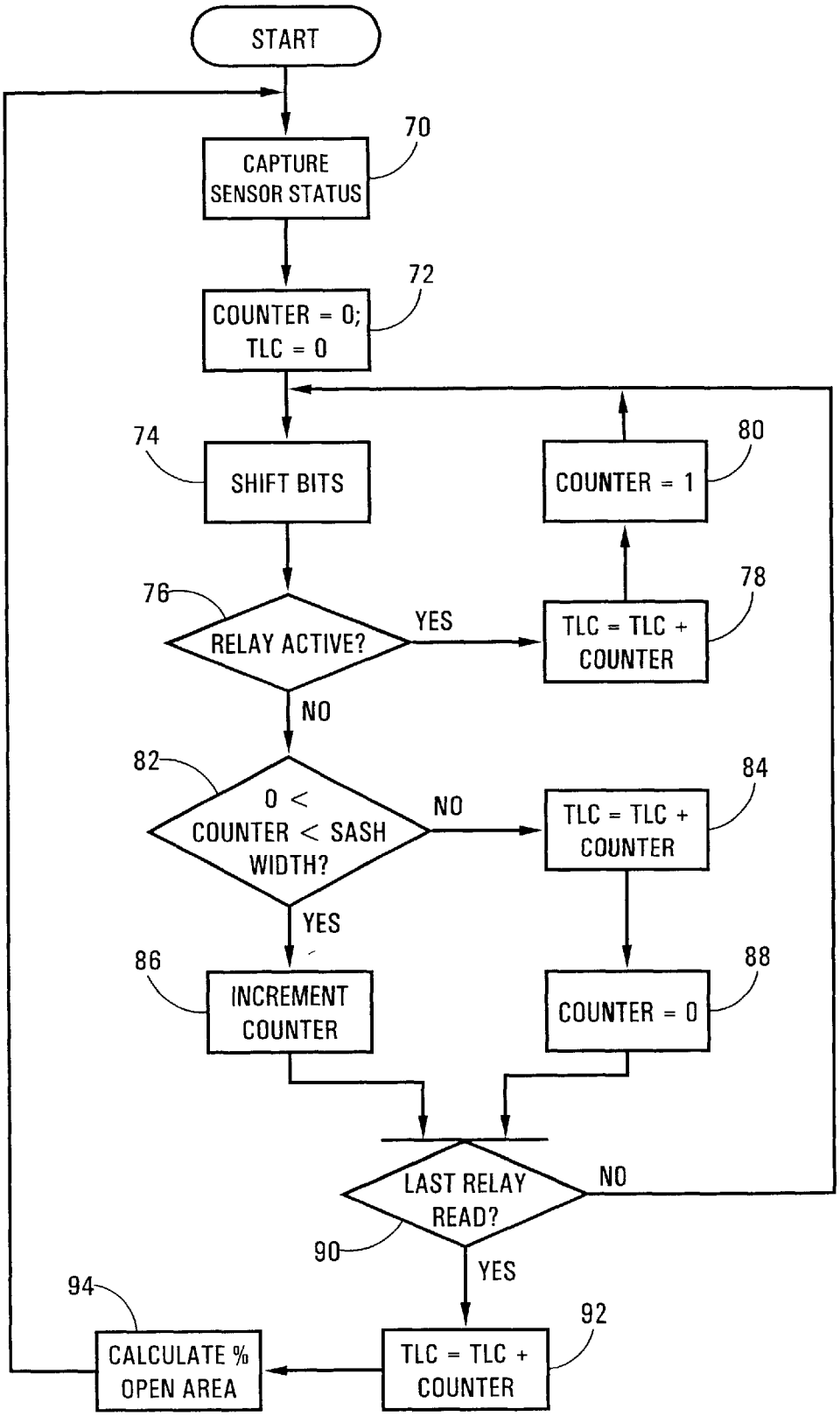
FIG. 7 is a flow chart outlining an exemplary method of calculating the open area of the fume hood doors in accordance with the present invention.

FIG. 7 illustrates a preferred method of calculating the percentage of open face area with the indicator elements positioned at the edge of a sash. Again, the track length and sash width are input into the microprocessor via dip switches, memory means, programming code, or the like. The microprocessor commands the shift registers to capture the status of the sensor elements (step 70) via their respective parallel inputs. A counter and a value for the total length covered (TLC) are initially set to zero (step 72). The microprocessor begins shifting the captured sensor status bits through the shift registers and into the microprocessor (step 74). For each bit shifted into the microprocessor, it is determined if the bit corresponds to an active relay in the sensing strip. If a bit indicative of an active relay is encountered at step 76, the value for TLC is updated by adding the counter to the current TLC value (step 78) and the counter is reset to a value of 1 (step 80). The process proceeds to step 74 and the next bit is received.

If a bit value corresponding to an inactivated sensor is received at step 76, it is then determined if the counter value is currently greater than zero and less than the sash width (step 82). Because the counter will not be greater than zero unless a bit corresponding to an active relay has previously been received, and because the indicator element is disposed at the edge of the sash, once the edge of the sash is detected, it is known that an area equal to the width of the sash will necessarily be covered. Thus, the counter is only incremented until either (1) the counter value reaches the sash width, after which the counter is no longer incremented (step 82), or (2) a bit corresponding to an active relay is encountered (step 76) causing the counter to be reset to a value of 1.

If the counter value is not between zero and the sash width, exclusive, at step 82, the value for TLC is updated by adding the counter to the current TLC value (step 84) and the counter is reset to a value of 0 (step 86) and the process proceeds to step 90. If the counter is between zero and the sash width, exclusive, at step 82, the counter is incremented by 1 (step 88) and the process continues to step 90.

At step 90, it is determined whether the last bit has been shifted into the microprocessor. If not, the process returns to step 74, the next bit is received, and the process continues. If the last bit has been received (step 90), the value for TLC is updated by adding the current counter value (step 92) and the percentage of open face area is calculated (step 94), for example, as follows:

$$\%\ \text{Open face area}=100[1-(TLC/TTL)],$$

or, equivalently, $$\%\ \text{Open face area}=100(TTL-TLC)/TTL,$$

where TTL is equal to the total track length. The open face area percent value is then output to the DAC, which transmits a 4–20 mA signal to the fume hood controller. The process is continuously repeated to monitor sash position and adjust the air flow velocity as necessary to maintain a face velocity which is substantially constant over time.

Figure 8:
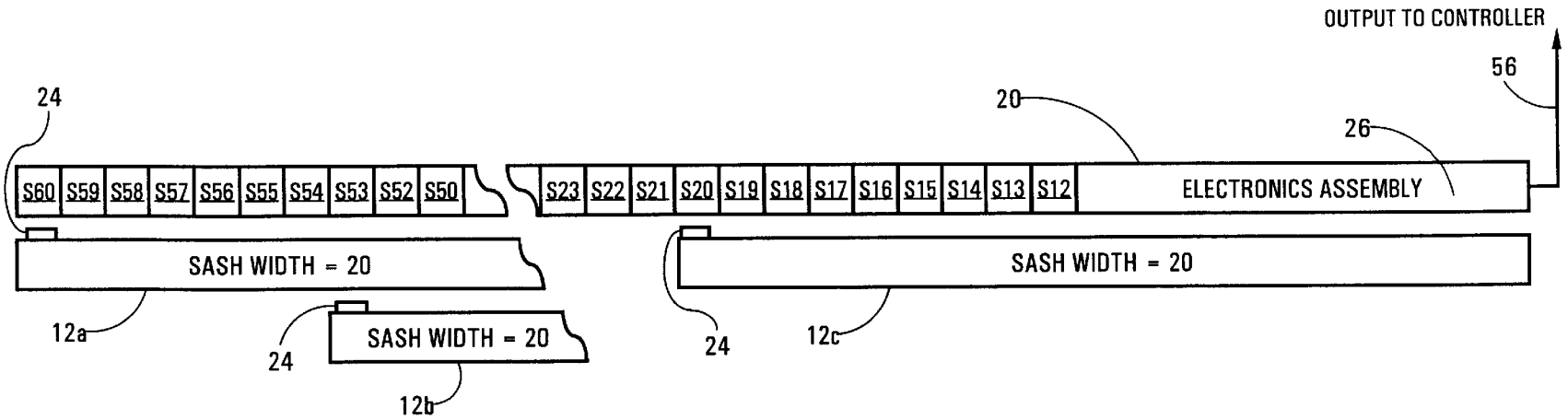
FIG. 8 shows an exemplary arrangement of sash doors in a fume hood having three sash doors.

FIG. 8 illustrates an exemplary sash position configuration for a fume hood having a total opening width of 60 units and three sashes movable to cover the opening, each sash having a width of 20 units. In the depicted configuration, the sensors at positions S60, S53, and S20 are activated by the indicator elements 24. Each unit of length may be, for example, about 0.5 cm to about 5 cm, preferably from about 1 to about 2.5 cm. In operation, the microprocessor commands the shift registers to capture the status of the sensor elements in parallel, and the bits are shifted one at a time through the cascaded registers and into the microcomputer. In the depicted example, the magnets are located on the left edge of the sash and the area to the right, up to the width of the sash, is therefore covered. Thus, the bits are shifted into the register beginning with the bit corresponding to the leftmost position, i.e., position S60.

When the processor determines that the bit for the first shifted bit indicates an active sensor at the position S60, the counter is started at 1, and increments up by one digit each time a bit indicating an inactive sensor element is shifted into the microprocessor thereafter. In the illustrated configuration, the counter is incremented as the bits corresponding to positions S59 through S54 are shifted into the microprocessor.

After the data bit corresponding to position S54 is shifted into the microprocessor, the counter contains the value 7. When the data bit corresponding to position S53 is received, indicating an active sensor element at that position, the current counter value (7) is added to the current value (0) for the variable TLC, which is indicative of the total length covered by the sashes to force the variable TLC to a value of 7. The counter is then reset to 1.

As the bits are continued to be shifted, the counter continues to be incremented so long as data indicative of an active bit is not received. Once the counter reaches the sash width, the counter stops incrementing, the width of the sash is added to the variable TLC, and the counter reset to zero. This occurs in the illustrated configuration when data corresponding to position S34 is received, and the counter/sash width value of 20 is added to the current value for TLC (7), thus assigning a new value of 27 to the variable TLC.

The bits continue to be shifted into the microprocessor until the bit corresponding to the last position sensor is received. As set forth above, position sensors are not necessary for the region located to the right of position S20, since the magnets 24 cannot travel within this region. In the illustrated embodiment, sensors are eliminated at positions beyond S12, forming the region 26, to allow the system to be used with fume hoods having sashes as small as 12 units in length. By eliminating the sensors in the region 26, the processing and other electronics can be placed in this area, thus allowing the system to be housed in a single strip. In this manner, the output cable carrying the control signal can be connected directly to the fume hood controller, avoiding the need for separately housing and mounting the processing electronics. The microprocessor treats the 11 missing or virtual sensors as though they are deactivated, in the manner described above. Of course, physical sensors can be provided along the entire track length, including the region 26, if desired. After all of the data is input into the microprocessor, the current counter value (20) is added to the current value of TLC (27), giving a total covered length of 47. A table displaying each incrementing and addition step performed in calculating the TLC for the sash configuration shown in FIG. 8 is shown in FIG. 9. The percentage of closed face area is calculated by dividing the value for TLC (47) by the total width (60) and converting to percent (78.3%). The percentage of open face area is then calculated by subtracting the value from 100 to give 21.7%. This value is then output to the DAC to generate the appropriate control signal, e.g., in the range of 4–20 mA. By using an industry standard 4–20 mA control signal, existing fume hoods and controllers can readily be retrofitted with the position sensing apparatus of the present invention.

It will be recognized that other data storage and processing techniques, other than the embodiment of FIG. 7 which uses counting and addition as the bits are shifted to the microprocessor, can be used. For example, the entire contents of the shift registers can be stored in a randomly accessible memory for subsequent processing. Also, an X-bit microprocessor can be used for the parallel input of each group of X sensor elements in place of the shift registers. As another option, the X-digit number from the shift register addresses a look-up table that is preprogrammed to convert the binary shift register number to percent open. Other algorithms or logic processes for converting the binary number to a percent can be implemented in other calculations performed in software, firmware, dedicated hardware, or combinations thereof. Also, the system can be adapted for placement of the indicator elements at locations other than an edge of the sash.

In a further embodiment, the horizontal sashes are mounted in a vertically movable frame. The vertical position can be determined in a number of ways, and is preferably determined in a known manner, such as with a resistive position sensor, such as a conventional position sensor using one or more potentiometers activated by a string pulley apparatus to vary the resistance in accordance with the vertical position of the frame. Alternately, the vertical position of the frame is determined using a vertically mounted sensing strip on the fume hood, employing parallel input sensor elements as described above. Exemplary systems employing both horizontal sash position sensors and vertical position sensors are depicted in FIGS. 10 and 11.

A resistive vertical position sensor 100, provides a resistive vertical position signal responsive to the vertical position of the frame, such as a 0 to 6 KΩ signal, to a resistance-to-voltage converter 102. The voltage signal is converted to a variable control current 106, preferably a 4–20 mA current, indicative of vertical position by a voltage-to-current converter 104.

A horizontal sensor array 150 collects sash horizontal position data as described above which is processed by processing circuitry 152 to generate a digital representation of the open face area of the fume hood opening which is converted to a variable control signal 156 by voltage-to-current converter 154.

Figure 10:
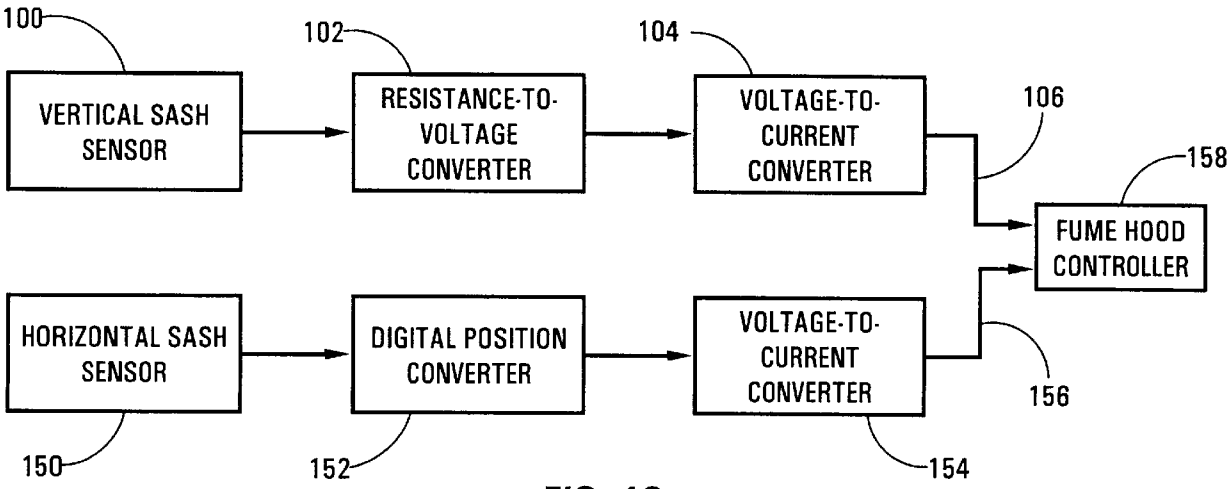
FIGS. 10 and 11 are block diagrams illustrating sash position sensing system for use with a fume hood having horizontally movable sashes in a vertically movable frame.
Figure 11:
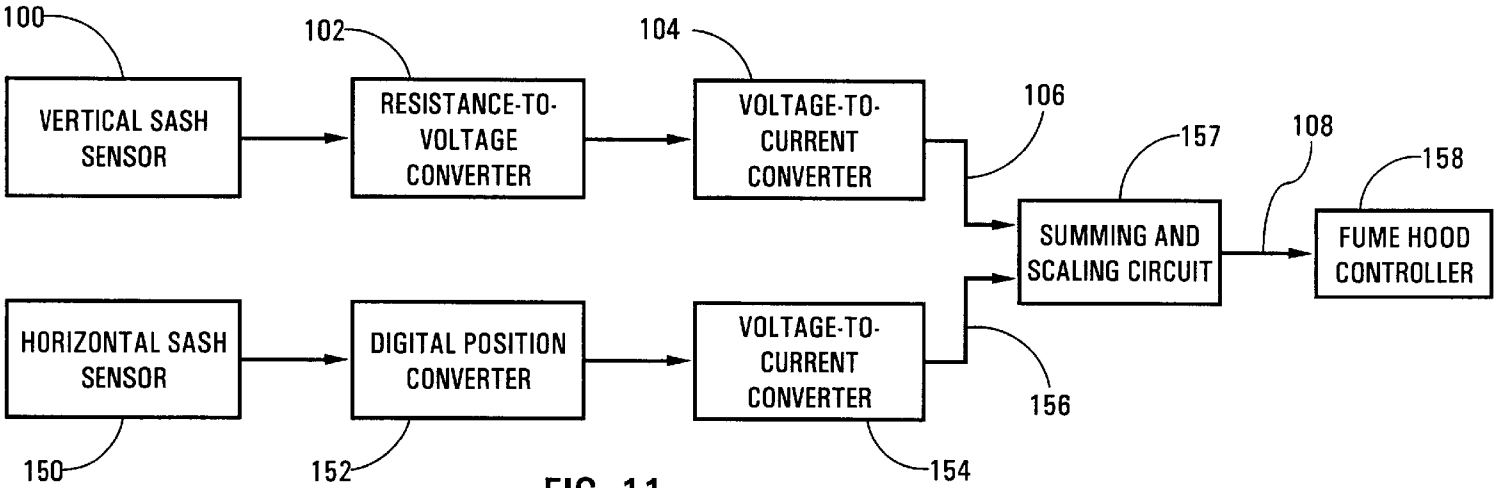

In FIG. 10, the fume hood controller 158 accepts separate vertical and horizontal control signals 106 and 156, respectively, to adjust the air flow accordingly to achieve the desired face velocity. In FIG. 11, a similar arrangement is shown wherein the vertical and horizontal control signals 106 and 156, respectively, are combined by a summing and scaling circuit 157 to provide a single control current, e.g., a variable 4–20 mA current, 108 to fume hood controller 158, which adjusts the air flow accordingly to obtain the desired face velocity.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A method for determining the positions of three or more sashes in a frame of a fume hood, the frame defining an opening and the sashes movable to change an extent to which the sashes cover the opening, each sash carrying an indicator element, the method comprising:

dividing the frame into a plurality of distinct regions along its length with a resolution finer than 5 cm and mounting a binary sensor Element within each region to define an array of binary sensor elements, the sensor element array being mounted in a line along the opening with individual elements less than 5 cm apart, each sensor element assuming a first state in response to one of the indicator elements being in minimal proximity therewith and a second state in response to the indicator elements being displaced therefrom; and simultaneously recording the state of each sensor element.

2. The method of claim 1, further comprising:

transmitting said state information to a processor; and determining the extent to which the sashes cover said opening.

3. The method of claim 2, further comprising:

passing an air stream having a rate of flow through said opening; and adjusting said rate of air flow to achieve a preselected face velocity.

4. The method of claim 3, further comprising:

monitoring the extent to which the sashes cover said opening periodically over a period of time; and adjusting the rate of air flow to maintain a preselected average face velocity.

5. The method of claim 2, further comprising:

configuring the speed of an air blower responsive to the extent to which the sashes cover the opening.

6. A method for determining the position of one or more sashes in a frame, the frame defines an opening and the sashes are horizontally movable in the frame, and the frame carrying the sashes is vertically movable, to change an extent to which the sashes cover the opening, each sash including an indicator element, the method comprising:

dividing the frame into a plurality of distinct regions along its length and associating a binary sensor element with each region, the regions being shorter than the sashes, each binary sensor element responsive to change status to indicate the presence of an indicator element in general alignment therewith;

simultaneously recording the status of each sensor element to indicate the extent to which the sashes are covering the opening;

sensing a vertical position of the frame; and outputting a signal representative of the vertical position of the frame.

7. In a fume hood having at least three movable sashes in a frame, a sash position sensing system comprising:

an indicator element affixed to each sash;

a single linear array of binary sensor elements extending along the frame, the sensor elements interacting with one or the indicator elements with which it is generally aligned to change the state thereof, such that the sensor elements that are generally aligned with each of the three indicator elements have one state and the sensor elements that are not aligned with the indicator elements have another state; and a computer-based information handling system coupled to the array of sensor elements, the computer-based information handling system recording binary state information for each sensor element simultaneously providing an indication of a location within the frame of each of the at least three sashes.

8. In a fume hood having N sashes slidably received in a frame, where $N \geqq 3$, a sash position sensing system comprising:

a state change element affixed to each sash;

a linear array of M digital sensor elements extending along the frame, where $M \leqq 10N$, the sensor elements each assuming a first state when one of the state change elements is generally aligned in minimum proximity therewith and a second state when all of the state change elements are displaced therefrom, such that the N sensor elements in the first state indicate positions of the N sashes; and a computer-based information handling system coupled to the array of sensor elements for periodically determining a state of each sensor element;

a means for electronically storing the state information for each sensor element simultaneously.

9. In the fume hood of claim 7, said computer-based information handling system including:

an electronic storage device for storing said state information.

10. In the fume hood of claim 9, the electronic storage device selected from random access memory, one or more microprocessors, and one or more programmable logic arrays.

11. In the fume hood of claim 7, the computer-based information handling system further comprising a microprocessor for calculating an open face area based on the recorded state information.

12. A fume hood comprising;

a housing including an opening formed therein;

N sashes movable to cover and uncover portions of said opening, where N is an integer greater than 3;

N indicator elements, each affixed to one of the N sashes;

a multiplicity of binary sensor elements disposed in a linear array extending along the frame parallel to the sashes, the indicator elements each changing state when one of the sensor elements is generally aligned therewith; and a computer-based information handling system coupled with each binary sensor element of the array of sensor elements to determine positions of the sashes b[] identifying the sensor elements of the sensor element array that are currently interacting with the indicator elements; and a microprocessor for calculating an open face area based on sash positions.

13. The fume hood of claim 12, said computer-based information handling system including:

a means for electronically storing state information for each sensor element of the array simultaneously.

14. The fume hood of claim 12, said computer-based information handling system including:

an electronic storage device for storing sensor element state information.

15. The fume hood of claim 14, the electronic storage device selected from random access memory, one or more microprocessors, and one or more programmable logic arrays.

16. In a fume hood having a plurality of movable sashes in a frame, the sashes being horizontally movable in the frame and the frame being vertically movable, a sash position sensing system comprising:

an indicator element affixed to each sash;

a single array of binary sensor elements extending along the frame, the binary sensor elements each interacting with a generally aligned one of said indicator elements;

a computer-based information handling system coupled to the binary array of sensor elements, the computer-based information handling system reading state information for each sensor element simultaneously;

a vertical sensor sensing a vertical position of the frame; and a circuit outputting a signal representative of the vertical position of the frame.

17. The fume hood of claim 12, further comprising:

a fan exhausting air from within the housing and drawing air ambient the opening into the housing.

18. The fume hood of claim 12, wherein the sashes are horizontally movable in the frame and the frame is vertically movable, further comprising:

a sensor sensing a vertical position of the frame; and a circuit outputting a signal representative of the vertical position of the frame.

19. A fume hood including:

a housing defining an access opening;

a fan which exhausts air from within the housing and draws ambient air through the opening into the housing;

N sashes movably mounted with the housing for uncovering and covering the opening to an adjustable degree, where N is an integer $\leqq 3$;

an array of reed switches mounted to the housing periodically across the opening, where M is an integer $\gg N$;

a plurality of magnets, one of the magnets being mounted on each sash to change a binary state of an adjacent reed switch;

a means for concurrently reading the plurality of reed switches to generate a binary number indicative of positions of the sashes in the opening;

a processor for converting the binary number into a fan control signal indicative of the degree to which the opening is uncovered;

a fan controller for controlling one of a fan speed and a damp in accordance with the fan control signal; and a means for periodically triggering the react switch reading means and the processor to update the binary number and the fan control signal.

20. In the fume hood of claim 8, wherein M=20N and the M sensor elements are mounted in a single line with a center-to-center spacing between 0.5 cm and 5.0 cm.

* * * * *